US009149947B2

(12) United States Patent
Zerfas et al.

(10) Patent No.: US 9,149,947 B2
(45) Date of Patent: Oct. 6, 2015

(54) DEVICE AND METHOD FOR FORMING A SPIRAL SHAPED OPENING IN A STENT

(75) Inventors: Jeff Zerfas, Bloomington, IN (US); Mohamed Fazni Abdulaziz, Bloomington, IN (US); Ray Amos, Spencer, IN (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 347 days.

(21) Appl. No.: 13/568,844

(22) Filed: Aug. 7, 2012

(65) Prior Publication Data

US 2013/0036885 A1 Feb. 14, 2013

Related U.S. Application Data

(60) Provisional application No. 61/521,238, filed on Aug. 8, 2011.

(51) Int. Cl.

| | |
|---|---|
| ***B26D 3/00*** | (2006.01) |
| ***B26D 3/10*** | (2006.01) |
| ***B26D 3/16*** | (2006.01) |
| *B26D 5/00* | (2006.01) |

(52) U.S. Cl.

CPC *B26D 3/10* (2013.01); *B26D 3/162* (2013.01); *B26D 5/005* (2013.01); *Y10T 83/0596* (2015.04); *Y10T 83/647* (2015.04)

(58) Field of Classification Search

CPC ..... B26D 3/10; B26D 3/162; B26D 5/005; Y10T 83/0596; Y10T 83/647

USPC ..... 83/37, 54, 322, 323, 329; 82/59, 60, 70, 82/89

See application file for complete search history.

(56) References Cited

U.S. PATENT DOCUMENTS

| | | | | |
|---|---|---|---|---|
| 3,370,491 | A * | 2/1968 | Cross | 83/37 |
| 3,771,393 | A * | 11/1973 | Gatto et al. | 82/53.1 |
| 4,587,874 | A * | 5/1986 | Lupke et al. | 83/340 |
| 4,756,217 | A * | 7/1988 | Holmes | 82/53.1 |
| 5,690,007 | A * | 11/1997 | Strange et al. | 82/70.1 |
| 2008/0097398 | A1 * | 4/2008 | Mitelberg et al. | 604/525 |

* cited by examiner

*Primary Examiner* — Stephen Choi

(74) *Attorney, Agent, or Firm* — Kacvinsky Daisak Bluni PLLC

(57) ABSTRACT

An apparatus includes a drive and a blade. The drive is configured to be operatively coupled to a tubular member. The drive is configured to move the tubular member from a first location with respect to the blade to a second location with respect to the blade. The blade is configured to rotate about an outer surface of the tubular member and to cut the tubular member as the drive moves the tubular member from the first location to the second location.

20 Claims, 5 Drawing Sheets

DEVICE AND METHOD FOR FORMING A SPIRAL SHAPED OPENING IN A STENT

CROSS REFERENCE TO RELATED APPLICATION

This application is a Nonprovisional of, and claims priority to, U.S. Provisional Application No. 61/521,238, filed on Aug. 8, 2011, entitled "DEVICE AND METHOD FOR FORMING A SPIRAL SHAPED OPENING IN A STENT", which is incorporated by reference herein in its entirety.

TECHNICAL FIELD

This disclosure is directed to devices and methods for forming a cut or an opening in a tubular member and more specifically to devices and methods for forming a spiral shaped opening in a stent.

BACKGROUND

Medical devices are often used to drain fluids within a patient's body. For example, ureteral stents can be used to assist the drainage of fluids through the urinary system of a patient. Some known ureteral stents include a tubular member and are configured to assist the drainage of fluid from one part of the urinary system to another part of the urinary system. Some known ureteral stents are configured to extend from a patient's kidney to a patient's bladder. Such known ureteral stents assist to drain fluid from the patient's kidney to the patient's bladder.

Regions of the urinary system are particularly sensitive and are prone to irritation by foreign objects. Thus, to avoid patient irritation and pain, it may be advantageous to provide urinary stents that is either configured to conform to the contours and/or movements of a patient's body or is configured to flex while disposed within the body of the patient. Thus, it may be advantageous to provide a urinary stent that is configured to conform to the contours of a patient's body. Additionally, it may be advantageous to provide a urinary stent that is flexible.

Some known urinary stents includes openings in the sidewalls of the stents to provide flexibility to the stent. Some known methods for forming the openings in the stents include disposing a mandrel within the lumen defined by the stent and cutting the sidewall of the stent with a cutting device, such as a blade. These methods, however, can lead to the dulling of the blade as it contacts and potentially cuts the mandrel that is disposed within the lumen of the stent. These methods also can lead to contamination of the stent.

Accordingly, it is desirable to provide a device and method for forming an opening in a stent that avoids the use of a mandrel and the potential contamination of the stent.

SUMMARY

An apparatus includes a drive and a blade. The drive is configured to be operatively coupled to a tubular member. The drive is configured to move the tubular member from a first location with respect to the blade to a second location with respect to the blade. The blade is configured to rotate about an outer surface of the tubular member and to cut the tubular member as the drive moves the tubular member from the first location to the second location.

A method of forming a cut in a tubular member includes moving the tubular member from a first location to a second location and cutting the tubular member while the tubular member moves from the first location to the second location.

DETAILED DESCRIPTION

Figure 1:
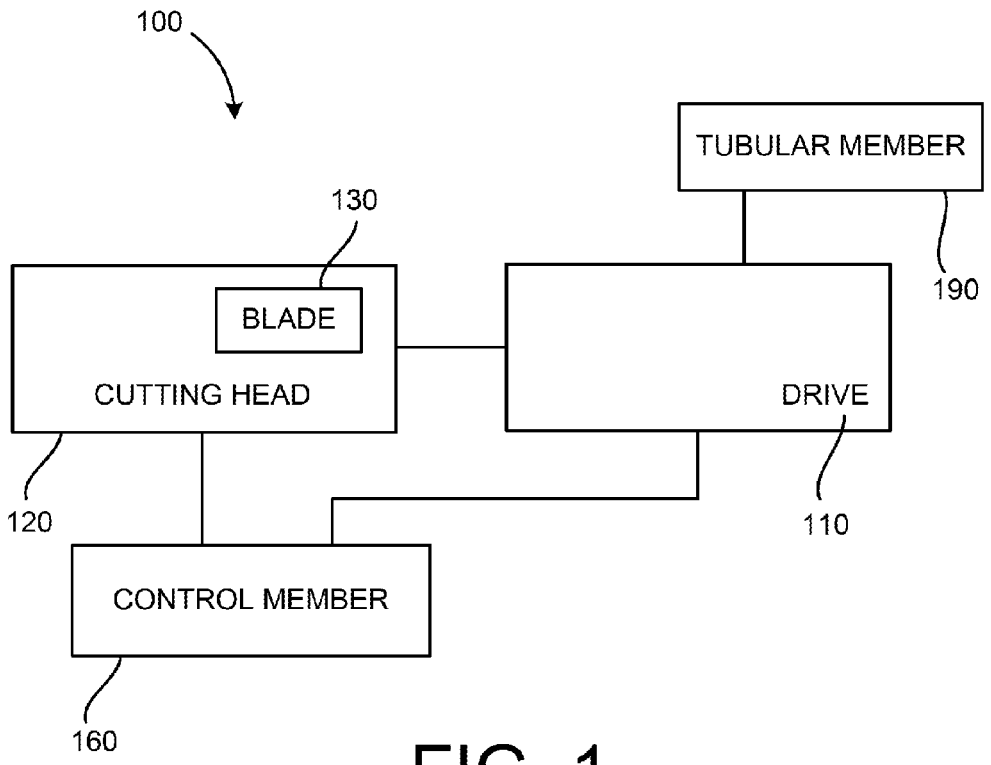
FIG. 1 is a schematic illustration of a device according to an embodiment of the invention.

FIG. 1 is a schematic view of an embodiment of a device 100 according to an embodiment of the invention. The device 100 is configured to cut or form an opening in a tubular member 190. For example, in some embodiments, the device 100 is configured to cut or form an opening in a stent. In some embodiments, the device 100 is configured to cut or form a helical or spiral opening in a bodily stent, such as a ureteral stent.

The device 100 includes a drive 110 and a cutting head 120. The drive 110 is configured to be operatively coupled to the tubular member 190 and to move the tubular member 190 from a first location to a second location. In some embodiments, the drive 110 is configured to move the tubular member 190 from a first location with respect to the cutting head 120 to a second location with respect to the cutting head 120. In other words, in some embodiments, the drive 110 is configured to move the tubular member 190 in a direction towards the cutting head 120.

The drive 110 may be any mechanism that is configured to be move the tubular member 190. For example, in some embodiments, the drive 110 includes a roller or a set of rollers that are configured to rotate and contact the tubular member to move the tubular member linearly toward the cutting head 120. In other embodiments, the drive 110 includes a track and is configured to move the tubular member along a track towards the cutting head 120.

The cutting head 120 includes a blade 130. The cutting head 120 is positioned with respect to the drive 110 such that the drive 110 may drive or move the tubular member 190 towards and adjacent to the cutting head 120. In some embodiments, the cutting head 120 is positioned with respect to the drive 110 such that the drive 110 may drive or move the tubular member 190 into a portion of the cutting head 120. In some embodiments, the cutting head 120 is operatively coupled to the drive 110. In some embodiments, the cutting head 120 includes a track or defines a portion that is configured to receive at least a portion of the tubular member 190.

The blade 130 is configured to cut the tubular member 190. For example, in some embodiments, the tubular member 190 includes a sidewall that defines a central passageway or lumen. In such embodiments, the blade 130 is configured to cut or sever a portion of the sidewall of the tubular member 190.

In some embodiments, the blade 130 is configured cut the tubular member 190 as the tubular member 190 is moved with respect to the blade 130 and cutting head 120. For example, in some embodiments, the blade 130 is positioned and configured to cut the tubular member 190 as the tubular member 190 is moved by the drive 110.

In some embodiments, the blade 130 is configured to move while it cuts or severs the tubular member 190. For example, in some embodiments, the blade 130 is configured to rotate about an outer surface of the tubular member 190 while the blade 130 is cutting the tubular member 190. For example, in some embodiments, as the drive moves the tubular member 190 from a first location to a second location, the cutting head 120 and the blade 130 rotate about the tubular member 190 and the blade 130 cuts or forms a spiral opening in the tubular member 190.

In the illustrated embodiment, the device 100 includes a control member 160. The control member 160 is operatively coupled to the cutting head 120 and the drive 110. For example, the control member 160 may be electrically and/or mechanically coupled to the cutting head 120 and the drive 110.

The control member 160 allows a user of the device 100 to activate or otherwise control the functions of the drive 110 and the cutting head 120. In some embodiments, a user of the device 100 may use the control member 160 to program the functions, such as the timings, the speed, or other functions, of the drive 110 and cutting head 120. Accordingly, the control member 160 may be used to sync the actions of the drive 110 and the cutting head 120. For example, the control member 160 may be used to cause the cutting head 120 and blade 130 to rotate as the drive 110 moves the tubular member from its first location to its second location.

In some embodiments, the cutting head 120 is removably coupled to the device 100. Accordingly, in some embodiments, a different cutting head may be used depending on the diameter of the tubular member being cut. Additionally, in some embodiments, the blade 130 is movably coupled to the cutting blade 120. Accordingly, in such embodiments, the blade 130 may be moved with respect to the cutting head 120 so that a different portion of the blade 130 contacts and cuts the tubular member (so as to not only use a dull a portion of the blade 130). Finally, in some embodiments, the blade 130 is removably coupled to the cutting head 120. In such embodiments, a used or dull blade may be replaced with a new blade.

In some embodiments, the control member 160 records the amount of use of the device 100. For example, in some embodiments, the control member 160 records the number of tubular members cut with a particular cutting head or blade, how many revolutions the cutting head or blade has made, or other information related to the amount of use of the device 100. The control member 160 may then provide an indication that the blade might need to be moved with respect to the cutting head and/or that the cutting head might need to be provided with a new blade.

Figure 2:
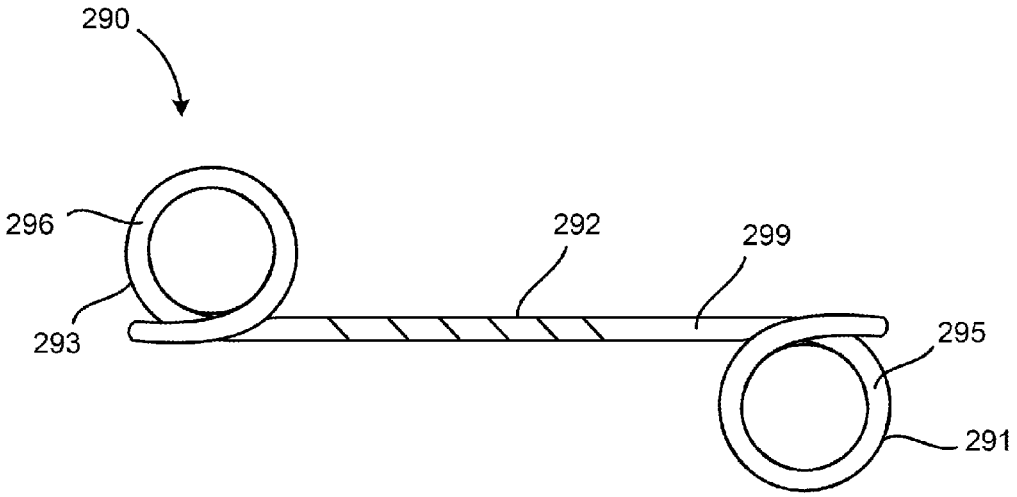
FIG. 2 is a top view of a stent defining a spiral opening.

FIG. 2 is a top view of a tubular member 290 that may be cut using a device such as device 100. The tubular member 290 defines an internal lumen and includes a first end portion 291, a second end portion 293, and a medial portion 292 disposed between the first end portion 291 and the second end portion 293. In some embodiments, the tubular member 290 includes a side wall 299 that defines the internal lumen (not illustrated). The tubular member 290 defines or includes a helical or spiral opening 294. The helical or spiral opening extends along at least a portion of the medial portion 292 of the tubular member. In some embodiments, the helical or spiral opening or slot is formed using a device such as device 100.

In some embodiments, the tubular member 290 is a stent such as a ureteral stent. In the illustrated embodiment, the tubular member 290 includes retention coils 295 and 296 that are configured to be placed in different portions of a body of a patient to help retain the tubular member 290 in place within the body of the patient. For example, the tubular member 290 may be configured to be inserted into a urinary tract of a patient. One retention member 295 may be configured to be placed within a kidney of a patient and the other retention member 296 may be configured to be placed within a bladder of a patient.

Figure 3:
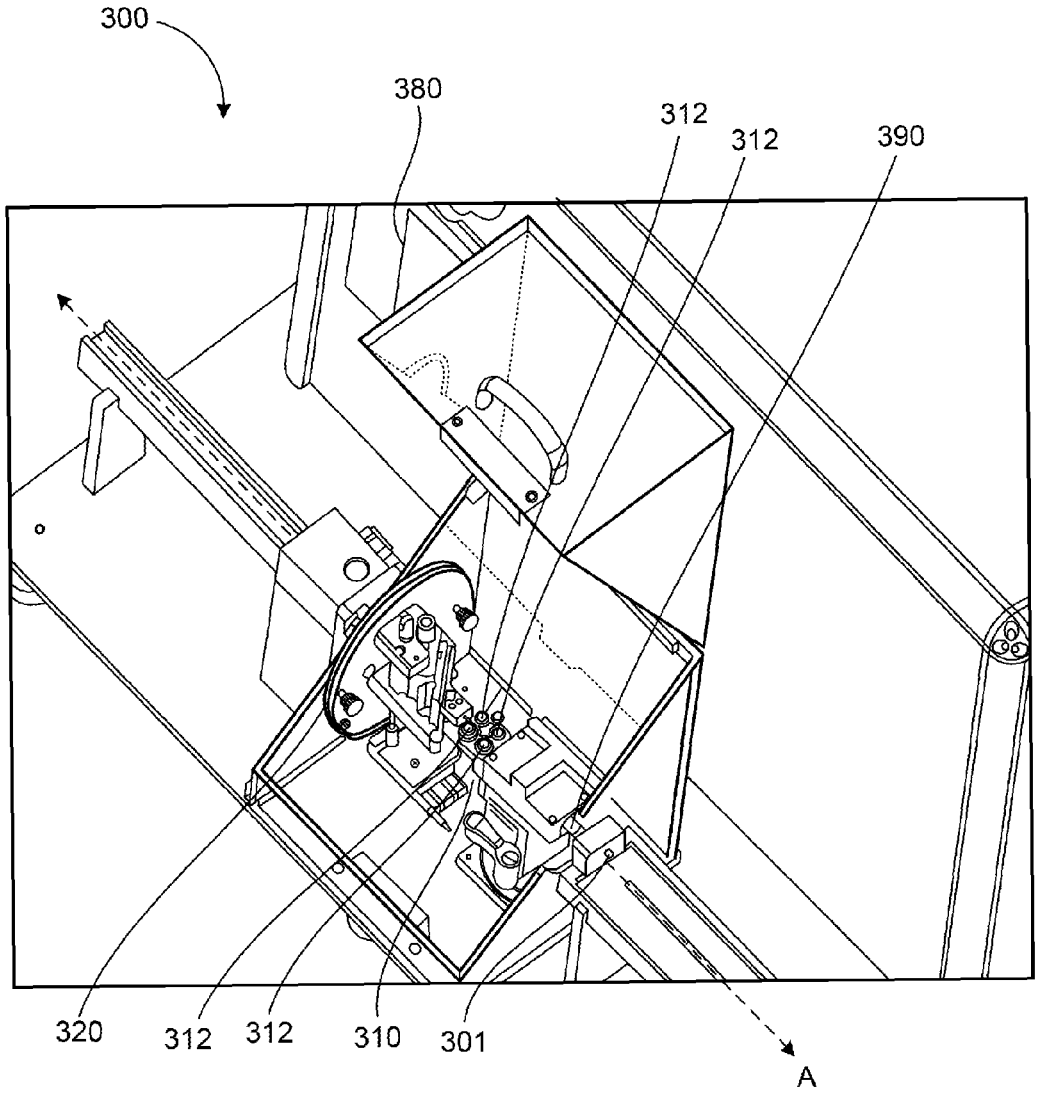
FIGS. 3-5 illustrate a device according to an embodiment of the invention.
Figure 4:
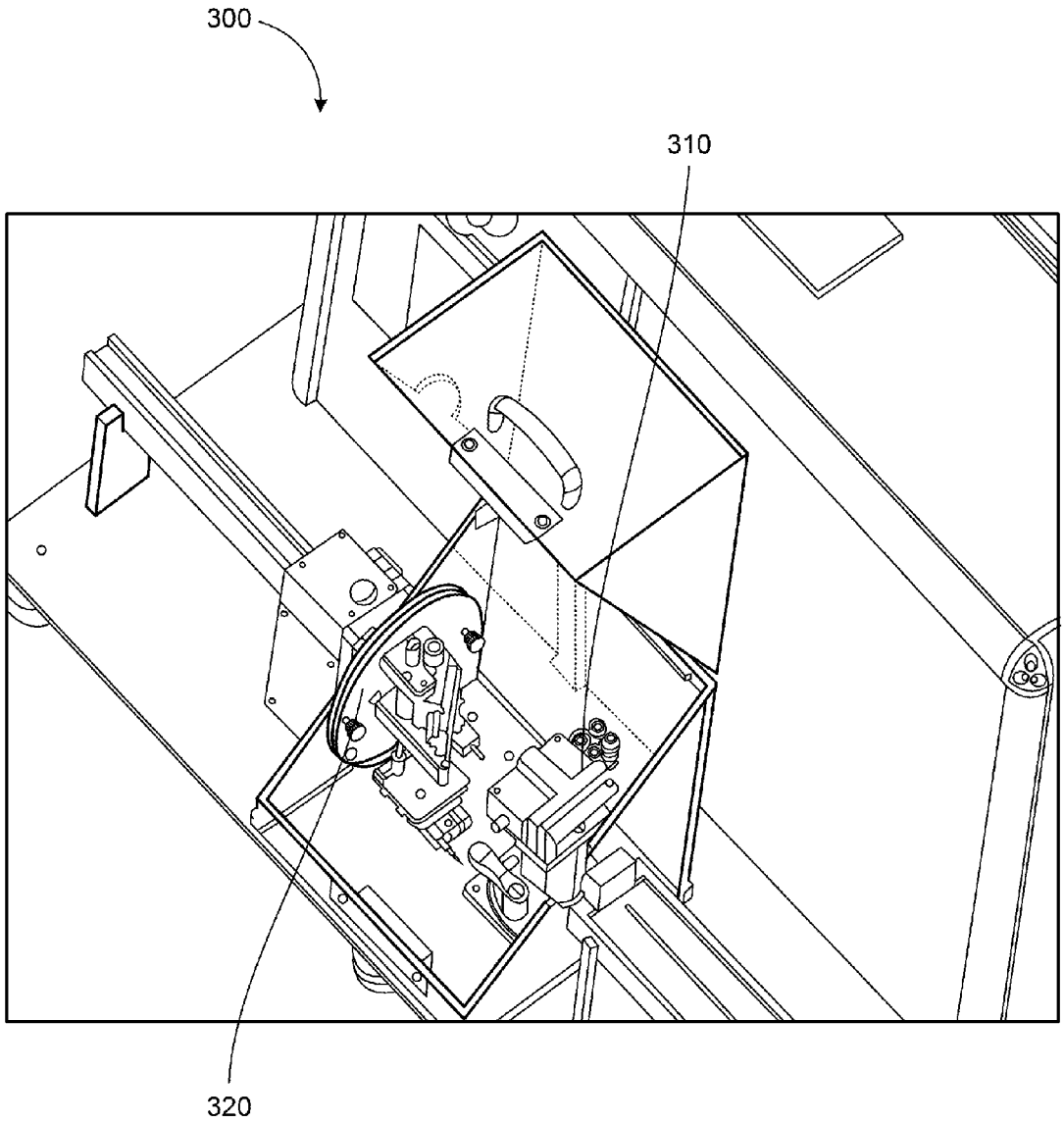
Figure 5:
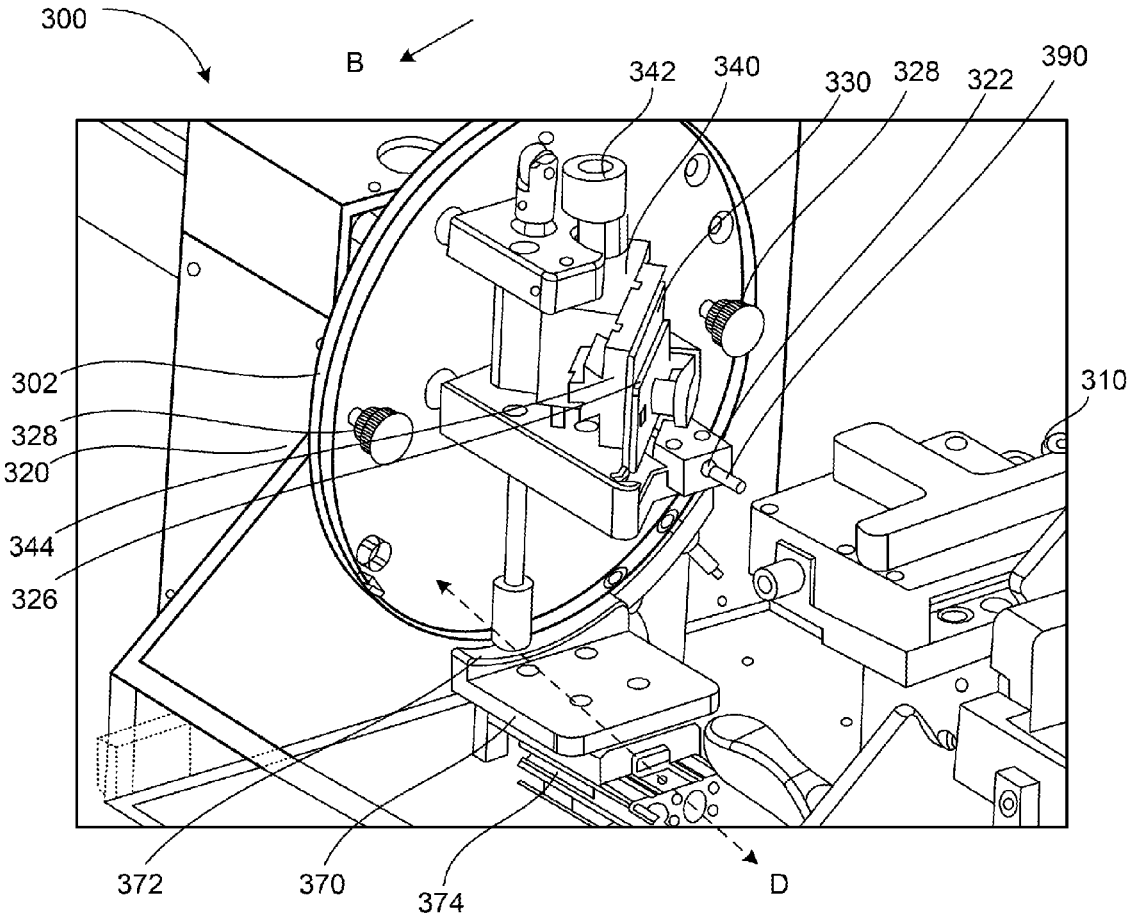

FIGS. 3-5 illustrate a device 300 according to an embodiment of the invention. The device 300 is configured to cut or form an opening in a tubular member 390. For example, in some embodiments, the device 300 is configured to cut or form an opening in a stent. In some embodiments, the device 300 is configured to cut or form a helical or spiral opening in a bodily stent, such as a ureteral stent.

In the illustrated embodiment, the device 300 includes or defines a movement pathway of the tubular member (along axis A of FIG. 3). The device 300 includes an entrance or insertion opening 301 into which the tubular member may be placed for movement and cutting. The device 300 also includes an exit port or opening (not illustrated) disposed opposite the insertion opening 301 and configured to pass the tubular member after the tubular member has been cut (as will be described in more detail below).

In some embodiments, the device 300 includes an indicator configured to indicate when the tubular member has been appropriately placed through the insertion opening 301 and into the device 300. For example, in some embodiments, the device includes a lip, ledge, or wall that is configured to contact the tubular member when the tubular member is placed within the device 300 to prevent over insertion of the tubular member. In some embodiments, the lip, ledge, or wall moves once the tubular member has been appropriately placed and the cutting process begins.

The device 300 includes a drive 310 and a cutting head 320. The drive 310 is configured to be operatively coupled to the tubular member 390 and to move the tubular member 390 from a first location to a second location. The tubular member 390 is disposed within the drive 310 in FIG. 3.

In the illustrated embodiment, the drive 310 includes a plurality of wheels 312. The wheels 312 are configured to engage the tubular member 390 (as illustrated in FIG. 3) and rotate to move the tubular member 390 within the device 300. For example, each of the wheels 312 can rotate in a first manner to move the tubular member 390 towards the cutting head 320 and can rotate in a second manner to move the tubular member 390 in a direction away from the cutting head 320. Specifically, the wheels 312 on one side of the tubular member 390 can rotate in a clockwise manner (when viewed from the top of the device 300) to move the tubular member 390 toward the cutting head 320 and can rotate in a counter clockwise manner to move the tubular member 390 away from the cutting head 320. Similarly, the wheels on the other side of the tubular member 390 may rotate in a counter clockwise manner to move the tubular member 390 toward the cutting head 320 and in a clockwise manner to move the tubular member 390 away from the cutting head 320.

Accordingly, in the illustrated embodiment, the drive 310 is configured to move the tubular member 390 from a first location with respect to the cutting head 320 to a second location with respect to the cutting head 320. Accordingly, the drive 310 is configured to move the tubular member 390 in a direction towards the cutting head 320.

As illustrated in FIGS. 4 and 5, in the illustrated embodiment, the drive 310 may be moved with respect to the device 300. Specifically, the drive 310 may be rotated or pivoted from a first, operating position (as illustrated in FIG. 3) to a second position (as illustrated in FIGS. 4 and 5. When the drive 310 is in the second position, there is an increased amount of space between the drive 310 and the cutting head 320. As will be described in more detail below, the cutting head 320 may be removed from the device 300 and replaced with another cutting head when the drive 310 is in its second position. In the illustrated embodiment, the drive 310 rotates about 90 degrees from its first position to its second position. In other embodiments, the drive 310 rotates more or less to travel from its first position to its second position.

The cutting head 320 is operatively coupled to the drive 310. The cutting head 320 includes a blade 330. The cutting head 320 is positioned with respect to the drive 310 such that the drive 310 may drive or move the tubular member 390 towards the cutting head 320 such that the tubular member 390 passes adjacent the blade 330. In the illustrated embodiment, the cutting head defines an opening or passageway 322 that is configured to receive the tubular member 390. The tubular member 390 is illustrated in FIG. 5 as being partially disposed within the opening or passageway 322.

Figure 6:
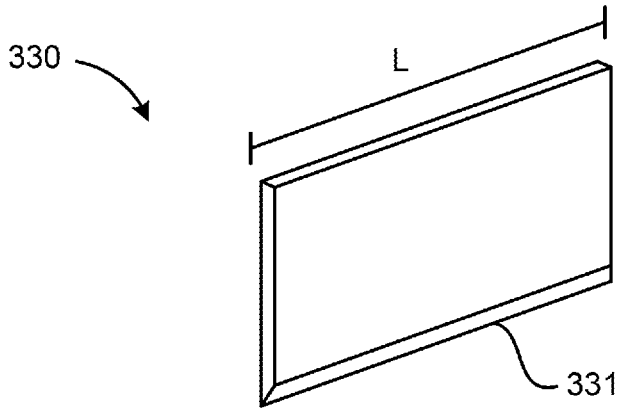
FIG. 6 is a perspective view of a blade according to an embodiment of the invention.

FIG. 6 is a perspective view of a blade 330 according to an embodiment of the invention. The blade 330 is configured to cut the tubular member 390. For example, in some embodiments, the tubular member 390 includes a sidewall that defines a central passageway or lumen. In such embodiments, the blade 330 is configured to cut or sever a portion of the sidewall of the tubular member 390.

In the illustrated embodiment, the blade 330 is coupled to the cutting head 320 such that it is disposed at an angle with respect to the movement path of the tubular member 390. For example, in some embodiments, the blade 330 is disposed at an angle of about 45 degree with respect to the movement path (i.e., along axis A) of the tubular member 390 (i.e., the pitch of the blade). In other embodiments, the blade 330 is disposed at an angle that is greater or less than 45 degrees with respect to the movement path of the tubular member 390.

The blade 330 is a straight blade that has a length L and has a cutting surface 331. The cutting surface 331 is configured to cut or sever a sidewall of the tubular member 390. The blade 330 is removably coupled to the cutting head 320. Specifically, knob 324 may be rotated to loosen the coupling mechanism 326 to remove the blade 330 from the cutting head 320. Accordingly, an old or dull blade 330 may be removed and replaced with a new blade.

The cutting head 320 also includes an indexer 340. The indexer 340 is configured to move the blade linearly towards or away from the movement path of the tubular member 390. In the illustrated embodiment, the indexer 340 is configured to move the blade 330 along axis D of FIG. 5. As the blade 330 moves linearly towards or away from the movement path of the tubular member 390, a different portion of the blade 330 will make contact and cut or sever the tubular member 390 as the device 300 operates (as will be described in more detail below). According, the indexer 340 and the movement of the blade 330 linearly with respect to the movement path of the tubular member 390 allows the entire cutting surface of the blade 330 to be used (rather than having to replace the blade after only a portion of the cutting surface is used or dulled).

The indexer 340 includes an adjustment knob 342. When the adjustment knob 342 is rotated, a blade carrier 344 moves the blade 330 linearly with respect to the movement path of the tubular member 390.

In the illustrated embodiment, the blade 330 is configured cut the tubular member 390 as the tubular member 390 is moved with respect to the blade 330 and cutting head 320. Specifically, as the blade 330 is configure to cut the tubular member 390 as the drive 310 moves the tubular member along axis A of FIG. 3 (the movement path of the tubular member 390).

In the illustrated embodiment, the blade 330 is configured to move while it cuts or severs the tubular member 390. The cutting head 320 is configured to rotate (and cause the blade 330 to rotate) about the movement path of the tubular member 390. For example in some embodiments, the cutting head 320 is configured to rotate along path B of FIG. 5. Thus, as the drive 310 moves the tubular member 390 from a first location to a second location, the cutting head 320 and the blade 330 rotate about the tubular member 390 and the blade 330 cuts the tubular member 390 to cut or form a spiral opening in a sidewall of the tubular member 390.

In the illustrated embodiment, the cutting head 320 is coupled to the device 300 via a coupler 302. The coupler 302 is configured to rotate with respect to the device 300 (and the movement path of the tubular member 390). Accordingly, the cutting head 320, when coupled to the coupler 302, is configured to rotate about the movement path of the tubular member 390.

In the illustrated embodiment, the cutting head 320 is coupled to the coupler 302 via a pair of screws 328. The screws 328 may be removed and the cutting head 320 may be removed from the coupler 302 and the device 300. The cutting head 320 or a different cutting head (with a blade placed at a different location or at a different pitch angle) may be coupled to the coupler 302 of the device 300.

In the illustrated embodiment, the device 300 includes a positioner 370. The positioner 370 is configured to move the cutting head 320 with respect to the movement path of the tubular member 390. Specifically, the positioner 370 is configured to move the cutting head 320 from a disengaged position (the blade 330 is spaced from the movement path of the tubular member 390 and is thus, not able to cut the tubular member) to an engaged position (the blade 330 is in a position to cut the tubular member 390). Accordingly, the cutting head 320 may rotate in the disengaged position and the blade 330 will not cut the tubular member 390. Then, once the cutting head 320 is up to speed, the positioner 370 may move the cutting head 320 into the engaged position and the blade 330 can cut the tubular member 390. In some embodiments, allowing the cutting head 320 to get up to its rotational speed before the blade 330 begins cutting the tubular member 390 allows the blade 330 to more consistently and more evenly cut the tubular member 390.

In the illustrated embodiment, the positioner 370 includes a cam member 372 and a drive 374. The cam member 372 includes a sloped surface and is configure to engage a portion of the cutting head 320 (wheel members 329 in the illustrated embodiment) to move the cutting head 320 from its disengaged position to its engaged position. Specifically, as the cam member 372 engages the wheels 329 of the cutting head 320, the cutting head 320 into its engaged position. Once the cutting head 320 is in its engaged position, magnets, such as earth magnets (not illustrated) are configured to retain the cutting head 320 in its engaged position. The earth magnets may be positioned in any location sufficient to help retain the cutting head 320 in its engaged position. In other embodiments, other mechanisms are configured to retain the cutting head 320 in its engaged position.

In some embodiments, the drive 374 of the positioner 370 is a pneumatic drive. In other embodiments, the drive 374 of the positioner 370 is a mechanical or other type of drive.

The drive 374 includes a track 375 and is operatively coupled to the cam member 372 to move the cam member 372 into and out of engagement with the wheel members 329 of the cutting head 320. Specifically, the drive 374 is configured to move the cam member 372 along axis D.

The device 300 includes a control member (not illustrated). The control member is operatively coupled to the various portions or components of the device 300, such as the cutting head 320 and the drive 310. For example, the control member may be electrically and/or mechanically coupled to the various components of the device 300, such as the cutting head 320 and the drive 310.

The control member allows a user of the device 300 to activate or otherwise control the functions of the various components of the device 300. In some embodiments, a user of the device 300 may use the control member to program the functions, such as the timings, the speed, or other functions, of the drive 310 and cutting head 320. Accordingly, the control member may be used to sync the actions of the drive 310, the cutting head 320, and the positioner 370. For example, the control member may be used to cause the cutting head 320 and blade 330 to rotate as the drive 310 moves the tubular member 390 from its first location to its second location.

In some embodiments, the control member includes a computer (such as a specific use computer or a general use computer) or a processor. In some embodiments, the control member includes modules that are configured to control the various components of the device 300. For example, in some embodiments, the control member includes a cutting head module that is configured to control the actions (such as the speed of rotation and timing) of the cutting head 320, a drive module that is configured to control the actions (such as the speed, timing, and direction of movement) of the drive 310, and a positioner module that is configured to control the actions (such as the position and movement of the cam member 372) of the positioner 370. In other embodiments, the control member includes modules that are configured to control various aspects of the device 300. For example, in some embodiments, the control member includes a speed module that is configured to control and adjust the speeds of the components of the device 300 and a timing module that is configured to control and adjust the timings of the movements of the various components of the device 300.

In some embodiments, one or more of the components or modules of the control member can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some embodiments, one or more portions of the drive module can be, or can include, a software module configured for execution by at least one processor (not shown). Similarly, one or more portions of the cutting head module can be a software module configured for execution by at least one processor (not shown). In some embodiments, the functionality of the components or modules can be included in different modules and/or components than those described above. For example, the functionality of the cutting head module can be included in a different module than the cutting head module, or divided into several different modules.

In the illustrated embodiment, the control member includes an input/display 380. The input/display 380 is configured to receive information regarding the device 300 or the details of the tubular member 390 from the user. The input/display 380 may also be configured to provide information to the user. For example, the input/display 380 may be configured to provide error or maintenance messages to the user.

In some embodiments, the control member records the amount of use of the device 300. For example, in some embodiments, the control member records the number of tubular members cut with a particular cutting head or blade, how many revolutions the cutting head or blade has made, or other information related to the amount of use of the device 300. The control member may then provide an indication via the input/display 380 that the blade might need to be moved with respect to the cutting head (for example, using the indexer 340) and/or that the cutting head might need to be provided with a new blade.

In some embodiments, the device 300 includes sensors that are configured to detect the positioning of the tubular member within the device 300. For example, in some embodiments, the sensors are operatively coupled to the control member to provide the control member with information regarding the location of the tubular member within the device 300. The sensors may be electrical or mechanical (such as mechanical switches) sensors. In some embodiments, the sensor or sensors are configured to indicate when the tubular member is positioned such that cutting of the tubular member should begin and/or when the tubular member is positioned such that cutting of the tubular member should cease.

Figure 7:
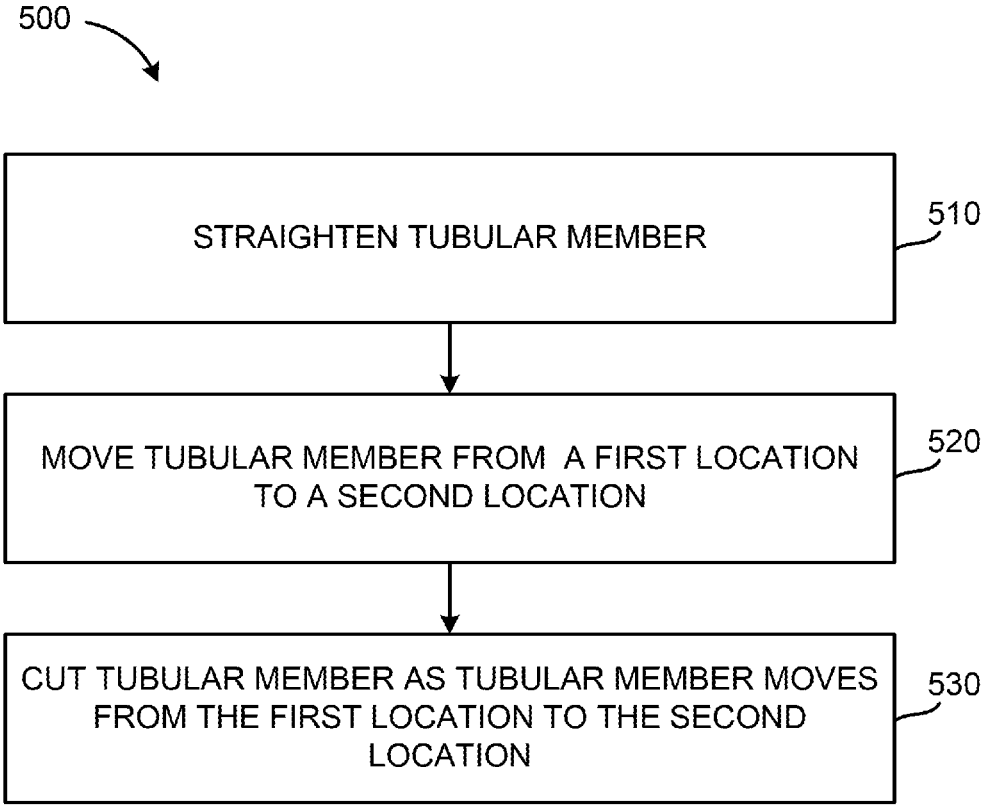
FIG. 7 is a flow chart of a method of forming a spiral opening in a tubular member according to an embodiment of the invention.

FIG. 7 is a flow chart illustrating a method 500 of forming a cut or opening in a tubular member according to an embodiment of the invention. At 510, a tubular member is placed in a linear configuration. For example, in some embodiments, the tubular member (such as a ureteral stent) includes non-linear end portions (such as retention portions that are configured to help retain the tubular member in place within a body of a patient). In some embodiments, the non-linear end portions of the tubular member are placed in a linear configuration. For example, in some embodiments, a pin or a cylindrical member is placed within each of the non-linear end portions of the tubular member (i.e., within the lumen defined by the tubular member) to straighten or place the non-linear end portions of the tubular member in a substantially linear configuration. In some embodiments, the pins do not extend into the portion of the tubular member that is to be cut. In other words, the lumen defined by the tubular member in the portion of the tubular member that is to be cut is empty (i.e., devoid of any pin or another other member).

In some embodiments, a pin is only placed in one of the non-linear end portions of the tubular member. Accordingly, in some embodiments, the method includes placing only a portion of the tubular member in a linear or substantially linear configuration.

At 520, the tubular member is moved from a first location to a second location different than the first location. For example, in some embodiments the moving the tubular member includes moving the tubular member from a first location with respect to a cutting head to a second location with respect to the cutting head. In some embodiments, the tubular member is engaged with a drive (such as wheels of a drive mechanism) to move the tubular member from a first location to a second location. In some embodiments, the tubular member is inserted into a channel or passageway to engage the tubular member with the drive.

At 530, the tubular member is cut. In some embodiment, the tubular member is cut to form a spiral or helical opening in a sidewall of the tubular member. For example, in some embodiments, the cutting the tubular member includes rotating a cutting head or blade about an outer surface of the tubular member. In some embodiments, the cutting the tubular member occurs while the tubular member is being moved with respect to the cutting head or blade (for example, while the tubular member is moved from its first location to its second location).

In some embodiments, the cutting the tubular member includes rotating the cutting head or the blade prior to cutting the tubular member. For example, in some embodiments, the method includes rotating the cutting head and blade until a desired speed of rotation is reached, moving the blade into position to cut the tubular member (for example, via a positioner), and then moving the tubular member relative to the rotating blade and cutting the tubular member as the tubular member passes the rotating blade.

In some embodiments, the method 500 includes indexing or moving the blade linearly with respect to the movement pathway of the tubular member. In such embodiments, the blade can be positioned such that different portions of the cutting surface of the blade are position to contact and cut the tubular member. In some embodiments, the blade may be indexed or moved linearly with respect to the movement pathway of the tubular member by rotating a knob (to cause the blade to be moved).

In some embodiments, the method includes detecting the location of the tubular member within the device. For example, in some embodiments, the device includes sensors that are configured to identify when the tubular member is in different positions within the device. Specifically, in some embodiments, the method includes detecting when the tubular member is in correct position to begin cutting the tubular member. In other embodiments, the method includes sensing or detecting when the tubular member is located such that the cutting should cease.

In some embodiments, an apparatus, includes a drive configured to be operatively coupled to a tubular member and a cutting head having a blade. The drive is configured to move the tubular member from a first location with respect to the blade to a second location with respect to the blade. The blade is configured to rotate about an outer surface of the tubular member and to cut the tubular member as the drive moves the tubular member from the first location to the second location.

In some embodiments, the blade is configured to cut a sidewall of the tubular member. In some embodiments, the cutting head includes a retainer portion and the blade is removably coupled to the retainer portion. In some embodiments, the cutting head includes an indexer. The indexer is configured to move the blade linearly from a first position to a second position different than the first position. In some embodiments, the cutting head includes an alignment tube configure to receive at least a portion of the tubular member. In some embodiments, the drive includes at least one roller. In some embodiments, the drive includes a plurality of rollers.

In some embodiments, the apparatus includes a sensor configured to determine when the tubular member has reached the second location. In some embodiment, the apparatus includes a pin configured to be disposed within a portion of a lumen defined by the tubular member.

In some embodiments, the drive is configured to move the tubular member in a direction from the first location to a second location. The blade is disposed at an angle with respect to the direction. In some embodiments, the drive is configured to move the tubular member in a direction from the first location to a second location. The blade is disposed at an acute angle with respect to the direction.

In some embodiments, a method of forming a cut in a tubular member, includes moving the tubular member from a first location to a second location; and cutting the tubular member while the tubular member moves from the first location to the second location.

In some embodiments, the cutting includes cutting a sidewall of the tubular member. In some embodiments, the cutting includes rotating a blade about an outer surface of tubular member.

In some embodiments, the method includes engaging the tubular member with a drive. In some embodiments, the method includes moving the blade member linearly from a first position to a second position prior to the moving the tubular member. In some embodiments, the method includes detecting when the tubular member is disposed at the second location. In some embodiments, the method includes detecting, using a sensor, when the tubular member is disposed at the second location. In some embodiments, the method includes placing at least a portion of the tubular member in a linear configuration. In some embodiments, the method includes disposing a pin within a lumen defined by the tubular member.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments.

What is claimed is:

1. An apparatus, comprising:

a drive configured to be operatively coupled to a tubular member;

a cutting head movably coupled to a blade, the blade having a straight portion, the straight portion of the blade having a cutting surface, the drive being configured to move the tubular member from a first location with respect to the blade to a second location with respect to the blade along a movement path, the blade being configured to rotate about an outer surface of the tubular member and to cut the tubular member with a first portion of the cutting surface of the blade as the drive moves the tubular member from the first location to the second location; and a control member configured to record an amount of use of the blade, the blade configured to move in relation to the cutting head from a first position to a second position such that a second portion of the cutting surface is positioned to cut the tubular member.

2. The apparatus of claim 1, wherein an entire length of the blade is a straight.

3. The apparatus of claim 1, wherein the cutting head includes a retainer portion, the blade being removably coupled to the retainer portion.

4. The apparatus of claim 1, wherein the cutting head includes an indexer, the indexer being configured to move the blade from the first position to the second position such that a different portion of the cutting surface of the blade can cut the tubular member, the indexer including an adjustment knob, wherein when the adjustment knob is rotated, a blade carrier linearly moves the blade with respect to the movement path of the tubular member.

5. The apparatus of claim 1, wherein the cutting head includes an alignment tube configure to receive at least a portion of the tubular member.

6. The apparatus of claim 1, wherein the cutting head defines an opening configured to receive the tubular member into a portion of the cutting head.

7. The apparatus of claim 1, wherein the drive includes a plurality of rollers such that the tubular member is linearly moved between the plurality of rollers towards the blade.

8. The apparatus of claim 1, further comprising:

a sensor configured to determine when the tubular member has reached the second location, the control member configured to determine at least one of a number of tubular members cut with the blade and a number of rotations of the blade, the control member configured to provide an indication that a position of the blade with respect to the cutting head be changed.

9. The apparatus of claim 1, wherein the tubular member defines a lumen and a portion having a curved configuration, the apparatus further comprising a pin configured to be disposed within the lumen of the portion of the tubular member such that the portion of the tubular member has a straight configuration.

10. The apparatus of claim 1, wherein the drive is configured to pivot from a first operating position to a second operating position, wherein when the drive is in the first operating position, the drive is separated from the cutting head by a first distance, wherein when the drive is in the second operating position, the drive is separated from the cutting head by a second distance, the second distance being greater than the first distance.

11. The apparatus of claim 1, wherein the drive is configured to move the tubular member in a direction from the first location to the second location, the blade being disposed at an acute angle with respect to the direction.

12. A method of forming a cut in a tubular member, comprising:

moving the tubular member from a first location to a second location along a movement path towards a cutting head moveably coupled to a blade, the blade including a straight portion having a cutting surface;

rotating the cutting head about an outer surface of the tubular member and cutting the tubular member with a first portion of the cutting surface of the blade while the tubular member moves from the first location to the second location such that the blade forms a spiral opening on the tubular member;

providing an indication that the blade be moved to a different position with respect to the cutting head;

moving the blade from a first position to a second position with respect to the cutting head; and rotating the cutting head about the outer surface of the tubular member such that the tubular member is cut with a second portion of the cutting surface of the blade.

13. The method of claim 12, wherein the cutting includes cutting a sidewall of the tubular member.

14. The method of claim 12, wherein the moving the blade from the first position to the second position includes rotating an adjustment knob causing a blade carrier to move the blade such that the second portion of the cutting surface can used to cut the tubular member.

15. The method of claim 12, further comprising:

engaging the tubular member with a drive.

16. The method of claim 12, further comprising:

moving the blade linearly prior to the moving the tubular member.

17. The method of claim 12, further comprising:

detecting when the tubular member is disposed at the second location.

18. The method of claim 12, further comprising:

detecting, using a sensor, when the tubular member is disposed at the second location.

19. The method of claim 12, further comprising:

placing at least a portion of the tubular member in a linear configuration.

20. The method of claim 12, further comprising:

disposing a pin within a lumen defined by the tubular member.

* * * * *